US006405896B2

(12) United States Patent
Jud et al.

(10) Patent No.: US 6,405,896 B2
(45) Date of Patent: Jun. 18, 2002

(54) PACKAGING MATERIAL WITH HINGED COVER SEAL

(75) Inventors: Wilfried Jud; Karl-Heinz Senger, both of Singen (DE)

(73) Assignee: Alusuisse Technology & Management Ltd. (CH)

( * ) Notice: Subject to any disclaimer, the term of this patent is extended or adjusted under 35 U.S.C. 154(b) by 0 days.

(21) Appl. No.: 09/859,523

(22) Filed: May 18, 2001

(30) Foreign Application Priority Data

Jun. 6, 2000 (CH) ..... 1112/00

(51) Int. Cl.[7] ..... B65D 35/08
(52) U.S. Cl. ..... 222/107
(58) Field of Search ..... 222/107, 541; 428/35, 36, 458, 461, 480, 483, 516

(56) References Cited

U.S. PATENT DOCUMENTS 4,096,946 A * 6/1978 Cook et al. ..... 428/35
4,257,536 A * 3/1981 Hilmar ..... 222/107
4,289,830 A * 9/1981 Knott, II ..... 428/480
4,528,219 A * 7/1985 Yamada et al. ..... 428/35
4,546,882 A * 10/1985 Hsu et al. ..... 222/107
4,548,338 A 10/1985 Sander
4,705,708 A * 11/1987 Briggs et al. ..... 428/35
5,036,889 A * 8/1991 Pherigo ..... 222/107
5,929,034 A 3/1994 Keller
5,656,346 A 8/1997 Hirt

FOREIGN PATENT DOCUMENTS

EP 0 496 704 A1 1/1992

* cited by examiner

*Primary Examiner*—Lesley D. Morris
*Assistant Examiner*—Thach H Bui
(74) *Attorney, Agent, or Firm*—Fisher, Christen & Sabol

(57) ABSTRACT

The packaging tube (10) comprises a tubular pipe (11) which has an opening (19) and a hinged cover seal (12) with a tubular sealing neck (14) which contains a spout (16) and an opening (18). The hinged cover seal (12) is manufactured in one piece, substantially from a said polypropylene, by injection moulding and comprises a hinged cover (13) which is integrally connected to the sealing neck (14) by way of a hinge (17). The tubular pipe (11) consists of a composite film (20) with two external films (21, 24) of a said polypropylene and an intermediate film (23) with barrier effect. The sealing neck (14) is drawn with its opening (11) over the tubular pipe opening (19) of the tubular pipe (11) or engages therein and forms an overlap area (30) with the tubular pipe (11), in which the hinged cover seal (12) is welded to one of the external films (24) of the tubular pipe composite film (20).

47 Claims, 3 Drawing Sheets

PACKAGING MATERIAL WITH HINGED COVER SEAL

Figure 1:
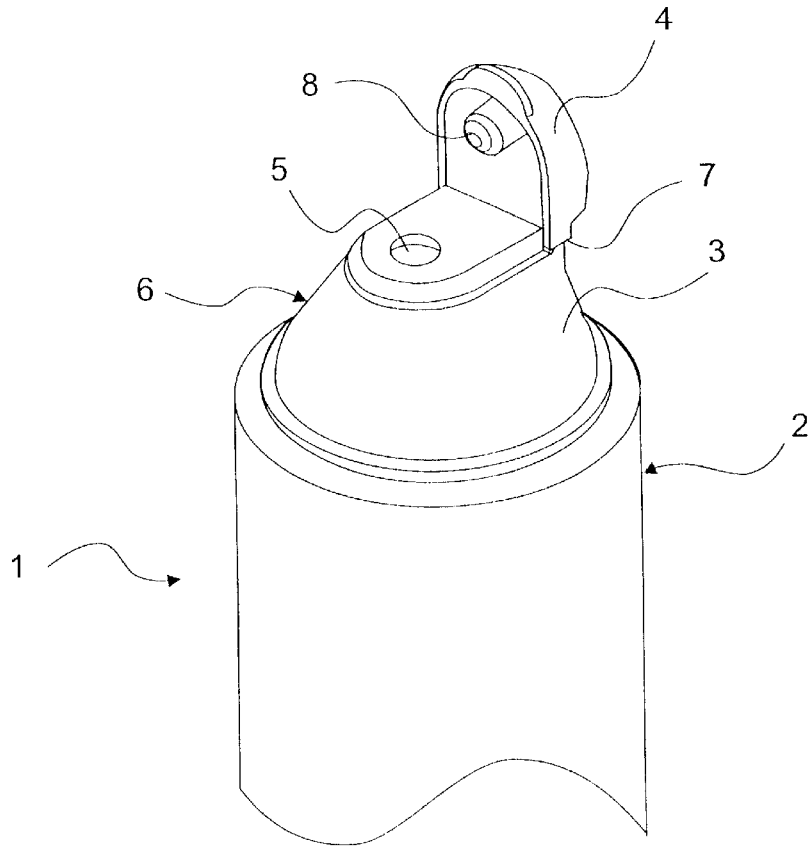

The present invention concerns a flexible packaging, in particular a packaging tube, with a container body, in particular a tubular pipe, having a container body opening and made of a composite film with an inner and an outer external film each comprising a cover layer, and with a single-piece hinged cover seal comprising a tubular sealing neck with a spout and a sealing neck opening and a hinged cover connected to the sealing neck by way of a hinge, and a process for its manufacture.

The advantages of hinged cover seals over for example screwed cover seals are known. Hinged cover seals can be operated for example quickly, simply and with one hand. The hinged cover also remains attached to the packaging after opening so that it cannot be lost.

Flexible packaging, in particular tube-like packaging or packaging tubes with paste-like contents, is therefore today increasingly fitted with hinged cover seals.

A known packaging tube with a hinged cover seal comprises; for example a container body or tubular pipe and a separately manufactured head part made of polyethylene with an opening and attached to the tubular pipe at the end by welding or sealing. The head part is usually equipped with a screw thread for attaching the hinged cover seal, whereby the hinged cover seal is screwed to the head part of packaging tube. The form-fit seal connection between the packaging container and the hinged cover seal allows for individual design of the separate packaging elements with regard to the materials used.

The packaging tube described is however expensive to manufacture, and with the tubular pipe, the head part and the hinged cover seal, at least three separate components must be produced and assembled into a complete packaging tube in additional process stages. EP 496 704 B1 describes for example a packaging tube with a tubular pipe and a head part. The tube body consists of a three-ply composite laminate with an intermediate layer or film with a barrier effect against gases and water vapour, coated on both sides with polyethylene layers. The head part contains a shoulder part and an opening and carries a thread to receive a screw seal. The head part is made of polyethylene processed using injection-moulding technology and is connected to the tube body by a welded connection.

Furthermore, packaging tubes are known in which the container body is manufactured together with the hinged cover seal in one piece using injection-moulding technology. For manufacturing reasons the wall of the tube body consists, in cross-section, of a single continuous plastic layer, and therefore usually has an unsatisfactory barrier effect against volatile substances such as gases and water vapour.

U.S. Pat. No. 5,036,889 describes a packaging tube with a container body made of a composite film with outer layers of polyethylene and a shoulder part integrated into the container body. A one-piece hinged cover seal made of polyethylene is sealed to the shoulder part on the container body.

The flexion strength of hinged cover seals made of polyethylene is however often unsatisfactory. This has the effect that the hinge connecting the hinged cover to the sealing neck is more susceptible to breakage.

The invention is therefore based on the task of proposing a flexible packaging, in particular a packaging tube, with a hinged cover which is resistant to breakage and flexion, which is made from as few components as possible and is therefore simple and cheap to manufacture.

According to the invention the task is solved in that the hinged cover seal is placed on the container body opening forming an overlap area, and a complete peripheral annular wall section of the sealing neck opening forms a superficial, plain weld or seal connection with at least one external film of the container body, and the hinged cover seal, at least in its outer layers and the external film or cover layer facing the overlap area, consists of a polypropylene, a co- or terpolymer of said polypropylene or a polyblend of said polypropylene.

The term annular wall section in this text refers not only to a design which is circular in top view. The annular wall section, and hence the sealing neck can in top view also for example be polygonal, elliptic, oval or rectangular in form. The term annular rather describes a wall section describing the sealing neck opening in full circumference, i.e. continuously surrounding, and of hollow body form with limited height extension.

The overlap area is suitably formed by an interlocking connection of the sealing neck with the container body. In a first version the sealing neck engages in the container body opening so that the inner external film or inner cover film of the container body facing the packaging contents forms an overlap area with the outer wall of the sealing neck.

In a second version the sealing neck is drawn over the container body opening so that the outer external film or the outer cover film of the container body facing away from the packaging contents forms an overlap area with the inner wall of the sealing neck.

In a third version, the container body engages in an annular recess, forked in cross-section, of the sealing neck where two annular leg strips of the sealing neck forming a groove form an overlap area with the two external films of the container body.

In a further version of the invention, the sealing neck can be overlapped on both sides in thee area of the sealing neck opening by films or composite films of the container body composite film, so that the sealing neck engages between two films or composite films of the container body composite film. The container body composite film in this case has in the area of the container body opening a separation along a connecting surface between two films or composite films over a particular section of the surface which also defines the overlap area.

The hinged cover seal and the packaging container are suitably joined together in the overlap area by a superficial, plane seal or weld joint.

In the version of the packaging as a packaging tube, the container body is present in the form of a tubular pipe. The tubular pipe can be a seamless tubular pipe, a tubular pipe with longitudinal seam or a spiral-wound tubular pipe. The invention also concerns tube-like packaging with a hinged cover seal.

Tubular pipes for packaging tubes are produced for example by rolling and joining with overlap a composite film in continuous form to form a pipe. Tubular pipes are cut to the required length from the pipe. Where applicable a shoulder-Like end is formed at one end to connect the tubular pipe to a hinged cover seal.

Suitable materials for the container body, in particular for the tubular pipe, are for example layers or films containing composites and made of thermoplastics based upon olefin, ester, amide, styrene or vinyl compounds. Furthermore, the composite film suitably has at least one film or layer with a barrier effect against gases and/or water vapour.

Typical examples of plastics for thermoplastic layers or films are polyethylene, polypropylene, polyalkylene terephthalate, polyethylene terephthalate, polyamide, polystyrene or copolymerisates of polystyrene with acrylonitrile or polystyrene with butadiene or terpolymerisates of polystyrene with synthetic rubbers and acrylonitrile or polyvinyl chloride.

The films or layers can in particular consist of a polyethylene (PE) such as high density polyethylene (HDPE with a density greater than 0.944 g/cm3), medium density polyethylene (MDPE density: 0.926–0.940 g, cm3), linear medium density polyethylene (LMDPE density 0.926–0.940 g/cm3), Low density polyethylene (LDPE, density: 0.91.0–0.925 g/cm3), and linear low density polyethylene (LLDPE, density 0.916–0.925 g/cm3), where the PE films can be drawn mono- or biaxially.

The films or layers can also in particular consist of a polypropylene (PP) such as amorphous, crystalline, high crystalline, isotactic, syndiotactic, atactic polypropylene or a mixture thereof, and axially or biaxially oriented or cast polypropylene, where the PP films can be drawn monoaxially or biaxially. The films or layers can moreover be homo-, co- or terpolymerisates and polyblends of polypropylene. These are for example ethylene/propylene multiblock copolymers (E/P-B), ethylene-propylene elastomers (EPM) , ethylene-propylene-diene elastomers (EPDM), ethylene/propylene/diene thermoplastic elastomers (ELITE), rubber-modified polypropylene (PP+EPM), and other co- or terpolymers or polyblends of polypropylene not listed.

Polyblends of polypropylene can also include polyblends of co- or terpolymers of polypropylene.

When the term "said polypropylene" is mentioned below, this refers to the above list amongst others.

The container body consists suitably of a composite film and contains an inner external film facing the contents of the packaging and an outer external film facing away from the contents of the packaging. The inner and outer external films contain in turn preferably an inner or outer cover layer arranged in the externally exposed area.

The inner and/or the outer external films can in turn consist of a composite film or a co-extrusion film containing a cover layer. The cover layer for its part is e.g. a mornofilm in the case of a composite film, or e.g. a layer in the case of a co-extrusion film. The external films can also be monofilms in which the cover layers correspond to the external films concerned.

The inner or outer cover layer can be the layer arranged in the external exposed area of a multi-layer inner or outer external film which is made by a co-extrusion process. These films can, for their part, be joined with further layers or films, e.g. with an intermediate layer or film and/or one or more further multi-layered co-extrusion films to form a container body composite film.

Cover films corresponding to the external films as monofilms can also be joined with further films or composite films to form said container body composite film.

In a preferred version the inner and outer external films of the container body composite film consist of a co-extrusion film.

The inner and/or outer cover layer, and in particular the cover layer of the inner or outer external film facing said overlap area, consist suitably of a film or layer made from a said polypropylene, co- or terpolymerisate or polyblend of said polypropylene.

In further preferred versions of the invention, the external films are monofilms, composite films or co-extrusion films with two, three or more layers, where the inner and/or the outer, and in particular the external film facing said overlap area, consist of a said polypropylene, co- or terpolymerisate or polyblend of said polypropylene.

The inner and/or outer external films, and in particular their cover layers, can also contain or consist of layers, films or composite films of PP moulding materials to IDIN 16774 such as for example:

PP-H: homopolymerisate of propylene,

PP-B:block copolymerisate of propylene with a mass percentage of up to 50% of one or more aliphatic olefins without functional groups (e.g. ethylene), PP-R:statistical copolymerisate of propylene with a mass percentage of up to 50% of one or more aliphatic olefins without functional groups (e.g. ethylene), PP-Q:mixtures of polymers with a mass percentage of at least 50% polypropylene of the groups H, B or R.

The external fiIms, in particular the external film which forms a material joint with the hinged cover seal on part of the surface, and in particular its cover layers, consist in the preferred version of a polyblend of polypropylene with polyethylene.

In a further version of the invention, the inner and/or outer external film can contain a reinforcing film to stiffen the container body composite film, in particular reinforcing film of a homopolymer of polypropylene. Ache reinforcing film is preferably an intermediate layer of a multi-layer composite film which forms the inner and/or outer external film.

The inner and/or outer external films can for example contain a monofilm, a composite film or a co-extrusion film with a cover layer of a said polypropylene, co- or terpolymerisate or polyblend of said polypropylene, and connected to this a reinforcing film of a homopolymer of polypropylene. Further layers or films made of plastic connected to the reinforcing film are possible. Preferably, the external films are three-ply and contain a reinforcing film of said type covered on both sides with a said monofilm, composite film or co-extrusion film, where a film connected to the reinforcing film contains the cover layer. Furthermore, the external films can consist of a two-ply composite with a said monofilm, composite film or co-extrusion film containing the cover layer and a said reinforcing layer.

Preferably, the outer external film and, in particular, the outer and inner external films contain a reinforcing film. The reinforcing film in the outer external film thus has a greater layer thickness than that of the inner external film.

The external films have for example an overall thickness of 20–250 $\mu$m, preferably 30–200 $\mu$m. In a particular version, the outer external film causes a stiffening of the composite film and has a greater layer thickness than the corresponding internal film, for example a 15–100 $\mu$m greater layer thickness. The inner and/or outer external films can contain TiO2 or be TiO2-free or transparent.

Container body composite films can contain, in addition to said external films, one or more further films or layers arranged between the external films, in particular an intermediate film or layer with a barrier effect against the passage or diffusion of selected or all gases or vapours such as air, oxygen, carbon dioxide, water vapour, or against active substances, flavourings and aromas. The choice of barrier layer depends in particular on the desired barrier effect.

A film with said barrier effect can e.g. be made from metal for example ferrous metals such as iron, galvanised iron, steel or non-ferrous metal such as chromium and in particular aluminium and its alloys. The metal film can have a thickness of e.g. 6–100 $\mu$m, preferably 6–50 $\mu$m and in particular 7–30 $\mu$m.

Further suitable intermediate films or layers with said barrier effect are for example organic barrier layers, e.g films of plastics such as polyvinylidene chloride (PV)C), polymers of ethyl-vinyl alcohol, ethylene vinyl alcohol copolymers (EVOH), polyacrylonitrile e.g. BAREX R, cyclo-olefin copolymers (COC), polyacrylic-polyamide copolymers, copolyesters, liquid crystal polymers (LCP), polyethylene terephthalate (PETPR) or aromatic and amorphous polyamides such as films containing acrylonitrile copolymers. The plastic films can have a thickness of e.g. 6–100 μm, in particular 10–80 μm.

Carrier films such as plastic films which contain ceramic or metallic layers applied in a vacuum thin film layer process by means of PVD (physical vapour deposition) or CVD (chemical vapour deposition) techniques, also have good barrier properties against gases and water vapour. Ceramic layers can for example be compounds of the formulae SiOx, in *vhicih x is a number from 0.9 up to 2, and aluminium oxide (Al2O3) or aluminium nitride, which are deposited in a vacuum on a carrier film in a thin layer e.g. in the range from 5–500 nm (nanometer) and in particular from 10–200 nm.

Metal layers of aluminium or one of said metals can also be deposited by sputtering (cathode sputtering) onto the surface of a carrier film.

In particular plastic films, e.g from the polyolefin series, with no or insufficient barrier properties, can have a unilateral or bilateral ceramic or metal coating with said properties.

Plastic carrier film can e.g. be a film made from polyamide, polyester, polyolefin, polyvinyl chloride, polycarbonate, or polyethylene terephthalate (PET). The thickness of this plastic film can amount to e.g. 6–100 μm, preferably 10–80 μm.

Said intermediate films or layers can also be used as barrier layers, in particular as intermediate layers or films with barrier effect, in the multi-layered hinged cover seal described below.

The container body composite films can, in addition to said external films and intermediate films or layers with a barrier effect, also contain further films, composite films or layers made from thermoplastic materials, e.g. the plastics listed initially, in particular polypropylene, polyethylene or polyalkylene terephthalate, polyethylene terephthalate or polyamide, polystyrene or a copolymerisate of polystyrene with acrylonitrile or polystyrene with butadiene or terpolymerisates of polystyrene with synthetic rubbers and acrylonitrile or polyvinyl chloride.

The container body composite films or individual films or layers thereof can be transparent, opaque or non-transparent. The container body composite films or individual films or layers thereof can also be colourless, lacquered or through-dyed.

The container body composite film suitably has an overall thickness of 100–600 μm, preferably 100–450 μm, and in particular 120–300 μm.

The individual films or composite films of the container body composite film can for example be produced by means of extrusion, co-extrusion or calendering. The individual films or composite films of the container body composite film can be joined by means of connecting layers. The connecting layers are preferably layers produced by means of laminate adhesives or laminate lacquers with a surface density of e.g. 1–100 g/m2, in particular 2–8 g/m2, or extrusion and/or co-extrusion layers made of e.g. a polyolefin blend of LL-DPE, LDPE, MDPE, HDPE or from EAA (ethylene-acrylic acid copolymer) or a propylene, co- or terpolymerisate or polyblend of polypropylene. Said extrusion or co-extrusion layers can have a thickness of e.g. 2–50 μm.

The surfaces of the films can be treated with a bonding agent. The films can also be subjected to corona, flame, plasma or ozone treatment in order to improve the bonding.

Preferred container body composite fills contain, between two external films consisting of a plastic made from or with one of said polypropylenes, co- or terpolymerisates or polyblends of said polypropylene, an intermediate film with a barrier effect and made of e.g. a polyethylene terephthalate, polyamide, polyester, EVOH, LCP or COC, or a metal such as aluminium or an aluminium alloy.

In another preferred version, on at least one side between an inner and/or outer external film and said intermediate film with barrier effect is arranged a reinforcing film from a said polypropylene, coor terpolymerisate or polyblend of said polypropylene with a thickness of e.g. 20–200 μm, preferably 40–150 μm, for stiffening of the container body composite film. The reinforcing film contains or comprises in particular a homopolymerisate of polypropylene. The reinforcing film can also as already stated be part of a composite film of one of the films, in particular the outer external film. The reinforcing film can also itself be a composite film or a co-extrusion film.

The inner external film lies, where applicable by way of a bonding, laminate or adhesive layer, preferably directly on the intermediate film or layer so that the layer thickness between the barrier layer and the packaging contents is as small as possible and the barrier effect occurs as close as possible to the packaging contents. The inner external film is preferably thinner than the outer external film. The inner external film can e.g. be 1–250 μm, preferably 10–150 μm, in particular 15–100 μm thinner than the outer external film.

In a further version of the invention, the outer external film lies, where applicable by way of a bonding, laminate or adhesive layer, directly on the intermediate film or layer with barrier effect, where in particular in this case the reinforcing layer(s) or film(s) is(are) part of the outer and/or inner external film.

The hinged cover seal is preferably a part produced in one piece by injection or compression moulding. The sealing neck of the hinged cover seal is suitably tubular and can for example be formed cylindrical, in particular circular cylindrical or conical, with a generated surface tapering towards the discharge opening. The hinge connecting the sealing neck with the hinged cover is suitably produced in the same injection moulding process as an integral component of the hinged cover seal.

The hinged cover seal can also contain an authenticity seal produced in the same process together with the hinged cover seal. The authenticity seal is preferably connected to the hinged cover seal by functional connecting bridges. The authenticity seal preferably consists substantially of one of said polypropylenes, co- or terpolymerisates or polyblends of said polypropylene. A special version of such an authenticity seal is described in detail in the following design examples.

The hinged cover seal consists substantially of one of said polypropylenes, co- or terpolymerisates or polyblends of said polypropylene. The term "substantially" is in particular to be interpreted in that the hinged cover seal can, as well as said plastic, also contain a film, layer or coating with barrier effect as is described below.

The hinged cover seal can contain or comprise amorphous crystalline, highly crystalline, isotactic, syndiotactic or atactic polypropylene and a mixture thereof, or be a cast polypropylene. Furthermore, the polypropylene can be a homo-, co- or terpolymerisate or a mixture thereof. Also, polyblends of polypropylene, e.g. a polyblend of polypropylene with polyethylene can also be used.

Possible co- or terpolymers and polyblends are for example ethylene/propylene multiblock copolymers (E/P-

B), ethylene-propylene elastomers (EPM), ethylene-propylene-diene elastomers (EDPM), ethylene-propylene-diene thermoplastic elastomers (EPTE), rubber-modified polypropylene (PP+EPM), and further co-or terpolymers or polyblends of polypropylene not listed.

Furthermore, the hinged cover seal can also comprise or contain P-P moulding materials to DIN 16774, for example:

PP-H:homopolymerisate of propylene,

PP-B:block copolymerisate of propylene with a mass percentage of up to 50% of one or more aliphatic olefins without functional groups (e.g. ethylene), PP-R:statistical copolymerisate of propylene with a mass percentage of up to 50% of one or more aliphatic olefins without functional groups (e.g. ethylene), PP-Q:mixtures of polymers with a mass percentage of at least 50% polypropylene of the groups H, B or R.

The hinged cover seal preferably consists substantially of a polyblend of polypropylene, in particular a polyblend of polypropylene with polyethylene.

With the aim of improving the cold impact resistance, said polypropylene-containing plastic can be enriched with atactic polypropylene. Said polypropylene-containing plastics can also contain stabilisers, e.g. to increase the heat resistance, and further additives e.g. mineral additives for the purpose of achieving or improving specific properties.

The melting behaviour of the plastic of the external film or cover layer of the external film is preferably matched to the melting behaviour of the plastic of the hinged cover seal.

Said material-related composition of the hinged cover seal also applies at least to the outer layers of the multi-layered hinged cover seal described below.

For high value packaging goods the hinged cover seal can contain an additional diffusion barrier in the form of a barrier layer, in particular a barrier layer from said list. The barrier effect of the hinged cover seal can be directed against certain substances such as water vapour, gases, flavourings or aromas.

This barrier layer can e.g. be a layer or film arranged on the surface of the hinged cover seal facing towards or away from the contents of the packaging. Examples of barrier layers for hinged cover seals are ceramic layers generated by vacuum thin film technology or film-like plastic layers. A film or layer with a barrier effect can be e.g. a metal or plastic film or layer containing or comprising PETP, EVOH, COC, LCP or an acrylonitrite copolymer.

Barrier layers can be applied to part or the entire surface of the hinged cover seal. In the preferred version, the hinged cover seal, and in particular the sealing neck, has a barrier layer arranged on part or the entire surface facing the packaging contents.

The barrier layer or film is preferably applied to part or the entire surface on one or on both sides of the hinged cover seal, for example by lamination or co-extrusion. The surface section of the hinged cover seal forming a material joint with the container body is suitably not provided with one of said films or layers with barrier effect.

In a further version of the invention, the hinged cover seal can be a multi-layered single-piece moulding produced in a combined co-extrusion/injection moulding process. The hinged cover seal is preferably an at least three-ply, in particular a three-ply, moulding with an intermediate layer with barrier effect against gases (air, oxygen, carbon dioxide and water vapour), flavourings and/or aromas.

The barrier layer can be one of said barrier layers, as can also be used in the container body. Preferably, the barrier layer is a plastic film of EVOH, PETP, polyamide and COC, and in particular LCP.

At least the outer layers, in particular the outer layers forming the overlap area, of the multi-layered hinged cover seal are made from one of said polypropylenes, co- or terpolymerisates or polyblends of said polypropylene.

In the preferred version only the sealing neck is multi-layered and contains a barrier layer.

The packaging container according to the invention can be produced in that the hinged cover seal with its sealing neck is welded or cast onto the container body opening of the prefabricated container to form a connecting seam, where the hinged cover seal, at least in its outer layers, and the external film or cover film facing the connecting seam consists of a said polypropylene, co- or terpolymer of said polypropylene or a polyblend of said polypropylene.

In one possible version of the invention the sealing neck, forming an overlap area with an annular wall section surrounding the sealing neck, is drawn over the container body opening or is pushed into engagement with this, where a seal or welded connection is formed in the overlap area between the sealing neck and the container body composite film.

The injection or compression moulding suitably takes place using multi-piece moulding tools consisting of male and female moulds (pressing mandrels).

The hinged cover seal can where applicable also be directly cast onto the container body, where the container body lies with the wall section forming the overlap area in the female or male mould of the forming tool.

Occasionally, a film or a composite film with barrier properties of the specified structure can be applied to the male or female mould, the cover film of which forms a material connection with the moulding during the injection or compression-moulding process to produce the hinged cover seal.

In a preferred version the multi-layer films or composite films with barrier effect of one of said structures are pre-produced with a film or layer in the outside position made from one of said polypropylenes, co- or terpolymerisates or polyblends of said polypropylene and connected by material joint with the hinged cover seal in the injection or compression moulding tool.

In a further version of the invention, the hinged cover seal can after production be coated with a ceramic barrier layer in a vacuum thin film process on one or both sides, on part or the entire surface, in particular on the surface facing the packaging contents.

The weld or seal connection in said overlap area between the hinged cover seal and the container body can be made by means of radiant or contact heat or external heating by fusing the hinged cover seal and/or adjacent external films, in particular the adjacent cover film, of the container body composite film.

Where applicable a contact pressure can be applied in the overlap area to the surface sections to be joined during welding or sealing.

The packaging according to the invention with a hinged cover seal made of polypropylene is distinguished from those made from polyethylene by, amongst other factors, a greater surface hardness, greater tensile strength, greater elastic resetting ability, higher temperature resistance and better long term stress resistance. The susceptibility to fracture of the hinge of the hinged cover seal, for example in the form of a fatigue fracture, is therefore substantially lower in the packaging according to the invention. Also, packaging with at least external films or cover layers of the container body composite film made of polypropylene and with a hinged cover seal of polypropylene is better suited to hot filming and sterilisation, in particular heat or radiation sterilisation, of the packaging contents. The packaging container according to the invention is further suited to higher local pressures on the longitudinal, end and head seams. Therefore, the packaging can be subjected to higher stresses or for the same stresses the wall thickness can be reduced compared with container bodies made from polyethylene, and hence the materials costs also reduced.

Figure 2:
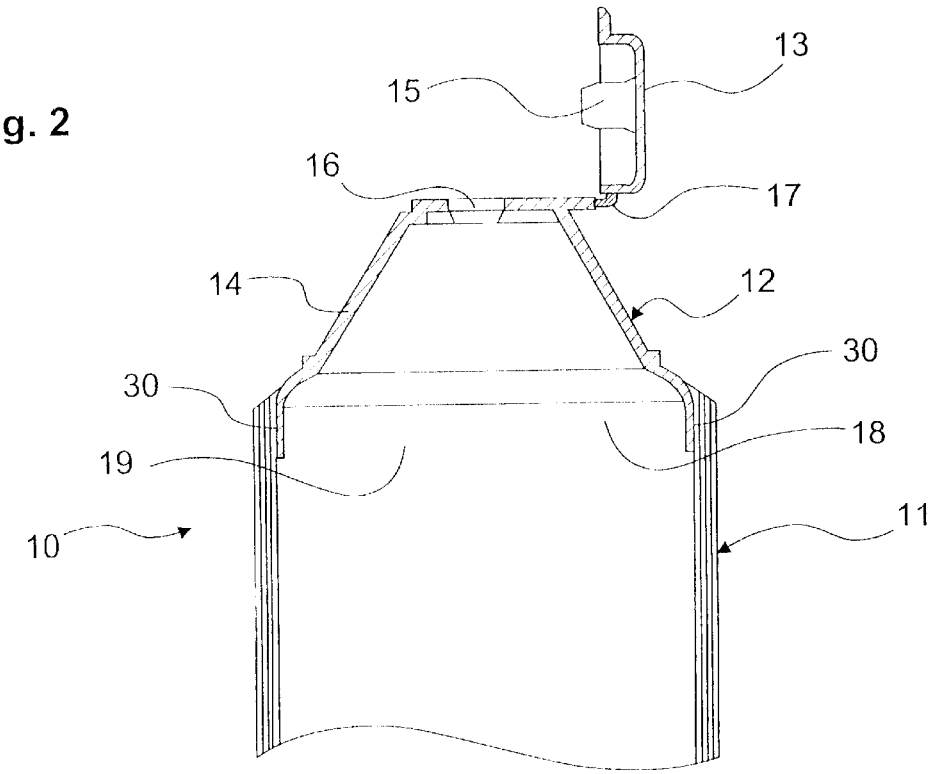
Figure 3A:
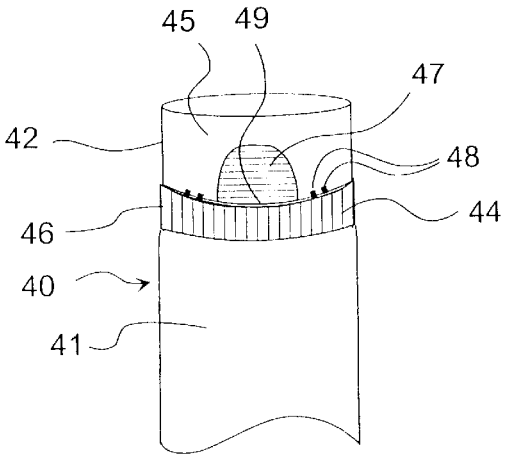
Figure 3B:
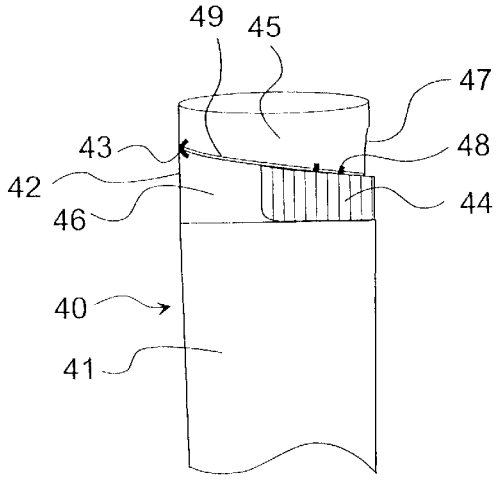
Figure 4A:
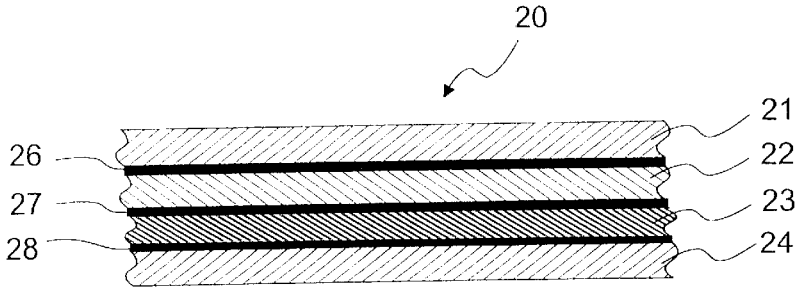
Figure 4B:
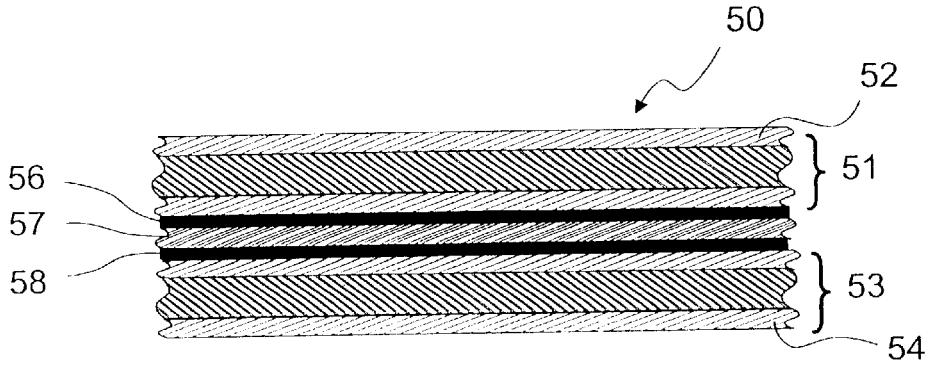
Figure 4C:
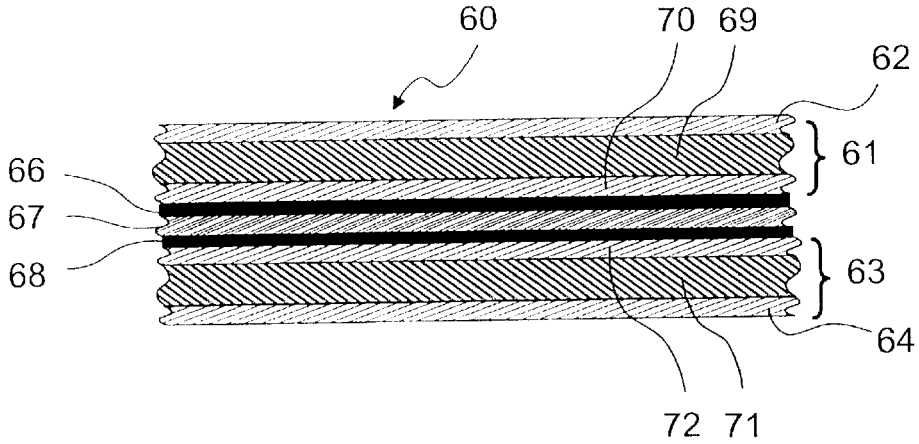

The invention is explained in more detail below as an example and with reference to the attached drawings. These show:

FIG. 1: a diagrammatic view of a tube upper part with hinged cover seal in perspective;

FIG. 2: a diagrammatic cross-sectional view through a tube upper part with hinged cover seal;

FIG. 3*a*: a front view of a further tubular packaging according to the invention;

FIG. 3*b*: a side view of a tubular packaging of FIG. 3*a* according to the invention;

FIG. 4*a*: a diagrammatic construction of a tubular pipe laminate according to the invention;

FIG. 4*b*: a diagrammatic construction of a further tubular pipe laminate according to the invention;

FIG. 4*c*: a diagrammatic construction of a further tubular pipe laminate according to the invention;

FIG. 1 shows a version as an example of a packaging tube 1 with hinged cover seal 6 and tubular pipe 2. The hinged cover seal 6 is made from a polyblend of polypropylene and contains a tubular conical sealing neck 3, a spout 5 and a hinged cover 4, which is flexibly connected by way of a hinge 7 to the sealing neck 3. The hinged cover 4 also has a pin 8 for tight closure of the spout 5.

FIG. 2 shows the cross-sectional view of the upper section of a further example design of a packaging tube 10 with a hinged cover seal 12 and a tubular pipe 11 as the container body. The hinged cover seal 12 is made from a polyblend of polypropylene and contains a tubular conical sealing neck 14, a hinged cover 13 with a pin 15 for tight closure of a spout 16. The hinged cover 13 is joined by way of a hinge 17 to the sealing neck 14. The sealing neck 14 engages, to form an overlap area 30 with an annular wall surface of the sealing neck opening 18, into the tubular pipe opening 19 as the container body opening. The sealing neck 14 and the tubular pipe 11 are welded together in their overlap area 30. The tubular pipe 11 consists of a tubular pipe composite film 20 according to FIG. 4*a*.

FIGS. 3*a–b* show a further tubular packaging 40 in the design of a standing tube consisting of a hinged cover seal 42 and tubular pipe 41 welded to the latter. The hinged cover seal 42 is circular cylindrical and composed of a sealing neck 46 and a hinged cover 45 connected to the latter by way of a hinge 43. In the front orientation, i.e. substantially opposite the hinge 43, is arranged a gripping aid 47 fitted with a roughness profile. The diameter of the hinged cover seal 42 corresponds substantially to the diameter of the tube.

Below the hinged cover 45 substantially opposite the hinge 43 is provided an authenticity seal 44 applied in the form of a strip which with its upper edge follows the opening line 49 between the sealing neck 46 and the hinged cover 45 and with its lower edge follows the edge of the tubular pipe and also the circular cylindrical shape of the sealing neck 46. The authenticity seal 44 extends over about half of the circumference of the hinged cover seal 42 and is connected to the hinged cover 45 by way of the connecting bridges 48 leading away beyond the opening line 49. Furthermore, the authenticity seal 44 is protected (not shown) against slippage in the direction of the hinged cover 45 by means of projections protruding from the sealing neck 46 and engaging in recesses in the authenticity seal 44 such that the hinged cover 45 is protected against opening by the authenticity seal 44 connected to it by way of the connecting bridges 48. Separating the authenticity seal 44 cuts the connecting bridges, whereby the authenticity seal 44 is broken and the hinged cover 45 can be opened. The spout (not shown) projects from the sealing neck in the form of a neck tapering towards the outlet opening. For the tight closure of the tubular packaging, the spout engages, in the closed condition of the hinged cover seal, in a circular cylindrical moulding on one base inner side of the hinged cover, where the internal diameter of said moulding corresponds approximately to the external diameter of the neck-like spout in its end section (not shown).

FIG. 4*a* shows the design of the tubular pipe composite film 20 of a packaging tube according to the invention (see also FIG. 2). The tubular pipe composite film 20 contains an inner external film 24 facing the packaging contents, and an outer external film 21 facing away from the packaging contents, made from a sealable polyblend of polypropylene with polyethylene which also corresponds to the cover layers. An intermediate film 23 with barrier effect against gases (air, oxygen, carbon dioxide, water vapour), flavourings and aromas is neighboring the inner external film 24. The intermediate film 23 is for example a plastic film made of EVOH, LCP, PETP, polyamide, or COC or a metal film.

Between the outer external film 21 and the intermediate film 23 is a reinforcing film 22 for stiffening the tubular pipe composite film 20 made from a homopolymer of polypropylene.

The individual films are connected to the tubular pipe composite film by means of connecting layers 26,27, 28 made from a laminate adhesive or laminate lacquer. The films can, however, be individually connected to each other by means of extrusion or co-extrusion, or the connecting layer can also be an extrusion or co-extrusion layer.

FIG. 4*b* shows a further version of a tubular pipe composite film 50 of a packaging tube according to the invention. The tubular pipe composite film 50 contains an inner external film 53 facing the packaging contents and an outer external firm 51 facing away from the packaging contents, both of which are made from a three-ply co-extrusion film of one of said polypropylenes, co- or terpolymerisates or polyblends of the said polypropylene. The external films 51, 53 each contain a cover layer 52, 54 which constitutes an external exposed layer of the co-extrusion film.

The thickness of the outer external film 51 is 70–150 $\mu$m and that of the inner external film 53 is 30–100 $\mu$m. The two external films have a density of 0.89–0.92 g/cm3. The outer external film 51 can optionally be a monofilm of a said polypropylene, co- or terpolymerisate or polyblend of said polypropylene of said density. Between the two external films 51, 53 is an intermediate film 57 with a barrier effect against gases (air, oxygen, carbon dioxide, water vapour), flavourings and aromas with a thickness of 10–25 $\mu$m. The intermediate film 57 is preferably a carrier film of polyethylene terephthalate (PET) coated with SiOx, where x is a number from 0.9 to 2.0. The intermediate film 57 is connected to the external films 51, 53 by a laminate lacquer 56, 58 with a surface density of 1–10 g/m2.

FIG. 4*c* shows a further version of a tubular pipe composite film 60 of a packaging tube according to the invention. The tubular pipe composite film 60 contains an inner external film 63 facing the packaging contents and an outer external film 61 facing away from the packaging contents, both of which are made from a three-ply co-extrusion film of a said polypropylene, co- or terpolymerisate or polyblend of said polypropylene with a density of 0.90–0.96 g/cm3.

The total thickness of the outer external film 61 is 55–250 μm, where the co-extrusion film of the outer external film 61 in turn consists of two external films 62, 70 of 7–50 μm thickness, where one of these constitutes the outer cover layer 62, and an intermediate film 69 of a thickness of 40–150 μm.

The total thickness of the inner external film 63 is 35–200 μm, where the co-extrusion film of the inner external film 63 in turn consists of two external films 64, 72 of thickness 7–50 μm, where one of these constitutes the inner cover layer 64, and an intermediate film 71 of a thickness of 20–100 μm.

The two external films 61, 63 have a density of 0.88–0.92 g/cm3. Between the two external films 61, 63 is an intermediate film 67 with a barrier effect against gases (air, oxygen, carbon dioxide, water vapour), flavourings and fragrances, preferably made of aluminium or an aluminium alloy of a thickness of 6–50 μm. The intermediate film 67 is connected to the external films 61, 63 by means of a laminate adhesive 66, 68 or by way of a mono- or co-extrusion film. Said mono- or co-extrusion film can have a thickness of e.g. 2–50 μm.

What is claimed is:

1. A flexible packaging (10) with a container body (11) having a container body opening (19) and made of a composite film (60) with an inner and outer external film (61, 63) each comprising a cover layer (62, 64), and with a single-piece hinged cover seal (12) comprising a tubular sealing neck (14) with a sealing neck opening (18) and a hinged cover (13), the hinged cover seal (12) is placed on the container body opening (19) forming an overlap area, and a complete peripheral annular wall section of the sealing neck opening (18) forms a superficial, plane weld or seal connection with at least one cover layer (62) of the container body (11), and the hinged cover seal (12) substantially consists of the external film (61) or cover layer (62) facing the overlap area, consists of a polypropylene, a copolymer or terpolymer of said polypropylene or a polyblend of said polypropylene.

2. The flexible packaging according to claim 1, wherein the hinged cover seal (12) is a single-piece injection molding, co-extrusion injection molding, multilayer injection molding or compression molding and substantially consists of a polypropylene, a copolymer or terpolymer of said polypropylene or a polyblend of said polypropylene.

3. The flexible packaging according to claim 2, wherein at least over part of inner surface and/or outer surface of the hinged cover seal (12) is a barrier layer or film with barrier effect against volatile substances.

4. The flexible packaging according to claim 3, wherein the volatile substances are gases, water vapor, flavorings and aromas.

5. The flexible packaging according to claim 4, wherein said barrier layer or film is a ceramic layer produced using thin film vacuum technology or a film-like deposit of plastic metal with barrier effect.

6. The flexible packaging according to claim 2, wherein the hinged cover seal is a single-piece injection molding and at least the sealing neck and/or hinged cover is a multilayer injection molding with an intermediate layer, produced using an extrusion process, with barrier effect against volatile substances.

7. The flexible packaging according to claim 6, wherein the volatile substances are gases, vapors, flavorings and aromas.

8. The flexible packaging according to claim 6, wherein the hinged cover seal is a multilayer injection molding with a plastic intermediate layer or film with barrier effect produced using an extrusion process and arranged at least in the neck and/or hinged cover between two layers of polypropylene, copolymer or terpolymer of polypropylene or a polyblend of polypropylene.

9. The flexible packaging according to claim 8, wherein the inner and/or outer layer (62, 64) facing the overlap area, or the inner and/or outer external film (61, 63) facing the overlap area of the container body composite film (60) consist of said polypropylene, copolymer or terpolymer of said polypropylene or a polyblend of said polypropylene.

10. The flexible packaging according to claim 9, wherein the cover layer (62, 64) facing the overlap area, and the external film (61, 63) facing the overlap area of the container body composite film (60) consists of a said polypropylene, copolymer or terpolymer of said polypropylene or a polyblend of said polypropylene.

11. The flexible packaging according of claim 9, wherein the inner and/or outer external film (61, 63) consists of a composite film or co-extrusion film of a polypropylene, copolymer or terpolymer of said polypropylene or a polyblend of said polypropylene.

12. The flexible packaging according to claim 11, wherein the inner external film and/or outer external film has a reinforcing layer to reinforce the container body composite film.

13. The flexible packaging according to claim 12, wherein the reinforcing layer comprises a homopolymer of polypropylene.

14. The flexible packaging according to claim 12, wherein the neck (14), with an annular wall section fully peripherally surrounding the neck opening (18), is drawn over the container body opening (11) or engages therein and lies against the inner or outer external film (61, 63) of the container body composite film (60) forming an overlap area (30), and the sealing neck (14) forms a weld or seal connection with the inner or outer external film (61, 63) in the overlap (30).

15. The flexible packaging according to claim 14, wherein the container body composite film (60) comprises an intermediate film or layer (67) arranged between the two external films (61, 63) with barrier effect against air, oxygen, water vapor, flavorings and/or aromas.

16. The flexible packaging according to claim 15, wherein the intermediate film or layer (67) lies directly against the two external films (61, 63).

17. The flexible packaging according to claim 15, wherein the container body composite film (60) and/or the hinged cover seal comprises an intermediate film or layer (23) with barrier effect against air, oxygen, water vapor, flavorings and/or aromas and said intermediate film or layer (23) is an aluminum or plastic film made of polyvinylidene chloride (PVDC), an ethyl vinyl alcohol polymer, ethylene vinyl alcohol copolymers (EVOH), cyclo-olefin copolymers (COC), a liquid crystal polymer (LCP) or a polyamide or a plastic film made of polyethylene terephthalate (PET) coated with SiOX where x is a number between 0.9 and 2.0.

18. The flexible packaging according to claim 17, wherein a reinforcing layer is arranged between the intermediate film or layer (67) with barrier effect and at least one of the two external films (61, 63), to strengthen the container body composite film.

19. The flexible packaging according to claim 18, wherein the reinforcing layer comprises a homopolymer of polypropylene.

20. The flexible packaging according to claim 18, wherein the two external films (61, 63) are the outer and inner external films.

21. The flexible packaging according to claim 1, wherein the flexible packaging (10) is a packaging tube and the container body (11) is a tubular pipe.

22. The flexible packaging according to claim 1, wherein at least over part of inner surface and/or outer surface of the hinged cover seal (12) is a barrier layer or film with barrier effect against volatile substances.

23. The flexible packaging according to claim 22, wherein the volatile substances are gases, vapors, flavorings and aromas.

24. The flexible packaging according to claim 22, wherein said barrier layer or film is a ceramic layer produced using thin film vacuum technology or a film-like deposit of plastic or metal with barrier effect.

25. The flexible packaging according to claim 1, wherein the hinged cover seal is a single-piece injection molding and at least the sealing neck and/or hinged cover is a multilayer injection molding with an intermediate layer, produced using an extrusion process, with barrier effect against volatile substances.

26. The flexible packaging material according to claim 25, wherein the volatile substances are gases, vapors, flavorings and aromas.

27. The flexible packaging according to claim 1, wherein the inner and/or outer layer (15, 17) facing the overlap area, or the inner and/or outer film (61, 63) facing the overlap area of the container body composite film (60) consists of a said polypropylene, copolymer or terpolymer of said polypropylene or a polyblend of said polypropylene.

28. The flexible packaging according to claim 27, wherein the cover layer (15, 17) facing the overlap area, and the external film (61, 63) facing the overlap area of the container body composite film (60) consists of a said polypropylene, copolymer or terpolymer of said polypropylene or a polyblend of said polypropylene.

29. The flexible packaging according to claim 1, wherein the inner and/or outer external film (61, 63) consists of a composite film or co-extrusion film of a polypropylene, copolymer or terpolymer of said polypropylene or a polyblend of said polypropylene.

30. The flexible packaging according to claim 1, wherein the inner and/or outer external film has a reinforcing layer to reinforce the container body composite film.

31. The flexible packaging according to claim 30, wherein the reinforcing layer comprises a homopolymer of polypropylene.

32. The flexible packaging according to claim 1, wherein the neck (14), with an annular wall section fully peripherally surrounding the neck opening (18), is drawn over the container body opening (11) or engages therein and lies against the inner or outer external film (61, 63) of the container body composite film (60) forming an overlap area (30), and the sealing neck (14) forms a weld or seal connection with the inner or outer external film (61, 63) in the overlap area (30).

33. The flexible packaging according to claim 1, wherein the container body composite film (60) comprises an intermediate film or layer (67) arranged between two external films (61, 63) with barrier effect against air, oxygen, water vapor, flavorings and/or aromas.

34. The flexible packaging according to claim 33, wherein the intermediate film or layer (67) lies directly against the two external films (61, 63).

35. The flexible packaging according to claim 1, wherein the container body composite film (60) and/or the hinged cover seal comprises an intermediate film or layer (23) with barrier effect against air, oxygen, water vapor, flavorings and/or aromas and said intermediate film or layer (23) is an aluminum or plastic film made of polyvinylidene chloride (PVDC), an ethyl vinyl alcohol polymer, ethylene vinyl alcohol copolymers (EVOH), cyclo-olefin copolymers (COC), a liquid crystal polymer (LCP) or a polyamide or a plastic film made of polyethylene terephthalate (PET) coated with $SiO_x$ where x is a number between 0.9 and 2.0.

36. The flexible packaging according to claim 1, wherein a reinforcing layer is arranged between the intermediate film or layer with barrier effect and at least one of the two external films to strengthen the container body composite film.

37. The flexible packaging according to claim 36, wherein the reinforcing layer comprises a homopolymer of polypropylene.

38. The flexible packaging according to claim 36, wherein the two external films are the outer and inner external films.

39. A process for producing a flexible packaging (10) according to claim 1, said flexible packaging (10) with a container body (11) having a container body opening (19) and made of a composite film (60) with an inner and outer external film (61, 63) each comprising a cover layer (15, 17), and with a single-piece hinged cover seal (12) comprising a tubular sealing neck (14) with a sealing neck opening (18), and a hinged cover (13) connected to the sealing neck (14) by way of a hinge (17), comprising casting or welding the hinged cover seal (12) with its sealing neck (14) onto the container body opening (19) of the prefabricated container body (11) to form a connecting seam, where the hinged cover seal (12), at least in its outer layers, and the external film or cover film of the container body composite film (60) facing the connecting seam consists of a said polypropylene, a copolymer or terpolymer of said polypropylene or a polyblend of said polypropylene.

40. The process according to claim 39, wherein the flexible packaging (10) is a packaging tube and the container body (11) is a tubular pipe.

41. The process according to claim 39, wherein the hinged cover seal is produced in one piece using a multilayer injection molding process and at least the sealing neck and/or hinged cover has an intermediate layer with barrier effect against volatile substances.

42. The process according to claim 41, wherein the volatile substances are gases, water vapor, flavorings and aromas.

43. The process according to claim 39, wherein the melt behaviors of the plastic materials used in the welded connection of the hinged cover (13) and the external film (61) are matched to each other.

44. The process according to claim 39, wherein the sealing neck (14), forming an overlap area (30) with an annular wall section surrounding the neck opening (18), is drawn over the container body opening (11) or is pushed into engagement with the container body opening (11) and a seal or weld connection is formed in the overlap area (30) between the sealing neck (14) and the container body composite film (60).

45. The process according to claim 44, wherein the hinged cover seal is produced in one piece using a multilayer injection molding process and at least the sealing neck and/or hinged cover has an intermediate layer with barrier effect against volatile substances.

46. The process according to claim 45, wherein the melt behaviors of the plastic materials used in the welded connection of the hinged cover (13) and the external film (61) are matched to each other.

47. The process according to claim 45, wherein the volatile substances are gases, water vapor, flavorings and aromas.

* * * * *